US006036118A

United States Patent [19]

Walker et al.

[11] Patent Number: 6,036,118

[45] **Date of Patent: *Mar. 14, 2000**

[54] LIQUID DELIVERY NOZZLE

[75] Inventors: David Graham Walker, Loughborough; Steven George Trim, Beeston; Ian Michael Clamp, Tutbury, all of United Kingdom

[73] Assignee: BG plc, Berkshire, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/913,357

[22] PCT Filed: Mar. 14, 1996

[86] PCT No.: PCT/GB96/00590

§ 371 Date: Oct. 24, 1997

§ 102(e) Date: Oct. 24, 1997

[87] PCT Pub. No.: WO96/28255

PCT Pub. Date: Sep. 19, 1996

[30] Foreign Application Priority Data

Mar. 16, 1995 [GB] United Kingdom ..... 9505319

[51] Int. Cl.[7] ..... B05B 1/26

[52] U.S. Cl. ..... 239/518; 239/524; 169/37

[58] Field of Search ..... 239/518, 524, 239/461, 523; 169/37

[56] References Cited

U.S. PATENT DOCUMENTS

| | | | |
|---|---|---|---|
| 1,723,180 | 8/1929 | Kerr | 239/524 X |
| 2,078,062 | 4/1937 | Crowley | 239/524 |
| 4,568,022 | 2/1986 | Scrivnor | 239/524 X |
| 4,624,414 | 11/1986 | Ferrazza | 239/524 X |
| 4,728,040 | 3/1988 | Healy et al. . | |

FOREIGN PATENT DOCUMENTS

| | | | |
|---|---|---|---|
| 1258983 | 3/1961 | France | 239/524 |
| 620373 | 3/1949 | United Kingdom . | |
| 1481 520 | 8/1977 | United Kingdom . | |
| 2 189 169 | 10/1987 | United Kingdom . | |

*Primary Examiner*—Andres Kashnikow
*Assistant Examiner*—Robin O. Evans
*Attorney, Agent, or Firm*—Oblon, Spivak, McClelland, Maier & Neustadt, P.C.

[57] ABSTRACT

A liquid delivery nozzle having a circular dispersion plate having an upwardly facing concave side spaced from an output end or orifice of a tube connected to a water supply which may deliver water to the output end at a pressure in the range of 0.3 to 0.5 bars. The water issuing from the output end impacts on the concave side and spreads thereover to fly off the periphery of the plate in the form of drops having little or no vertical velocity component. The major part of the water issuing from the tube is converted into large drops of at least 0.7 mm in diameter. The nozzle can be used in an installation to prevent, suppress or impede the occurrence or development of explosions.

43 Claims, 5 Drawing Sheets

LIQUID DELIVERY NOZZLE

This invention concerns a liquid delivery nozzle.

The liquid delivered by the nozzle may be water.

An object of the invention is to provide a liquid delivery nozzle which may be constructed and so used as to deliver water in the form of stream of drops of which the majority are large drops meaning water drops each having a diameter of at least substantially 0.7 m.m. or greater.

According to the invention a liquid delivery nozzle comprises a tube for liquid to be introduced into one end of said tube and emerge from another or output end of the tube, a dispersion plate of dish-form being concave on one side of said plate, said output end facing said concave side of the plate for emergent liquid to be directed against the concave side, said dispersion plate being impervious, and and said concave side being substantially smooth and continuous.

In use the liquid may be water, and the nozzle may be disposed with its tube in a substantially vertical attitude and with the concave side of the plate facing upwards so that water emerging from the output end of the tube hits the plate and then travels over the concave surface of the plate to a periphery of the plate for which periphery the water is discharged in said relatively large drops.

We believe that such water drops delivered continuously in the form of a stream or curtain can prevent, suppress or impede the occurrence, development, progress or effect of an explosion of explosive gas, vapour, or dust.

A plurality of spaced nozzles may be mounted at/or in the vicinity of an area where explosive material, for example combustible gases or liquids, is being handled, or stored for water to be delivered to the nozzles in the event of a potentially explosive condition being detected. Preferably the nozzles are mounted at elevated positions. The nozzles may be used at oil or fuel gas drilling or production platforms or installations, oil refineries, fuel gas production sites, at storage sites of explosive or inflammable gas or liquid, and at chemical plants. The gas referred to above may be natural gas.

Various aspects of the invention will now be further described with reference to the accompanying drawings in which:

FIG. 1 is a fragmentary view, partly in section on line I—I in FIG. 2, of an embodiment of a liquid delivery nozzle formed according to the invention;

FIG. 2 in a section on the line II—II in FIG. 1;

FIG. 3 in an inverse plan view in the direction of arrow III of the delivery nozzle in FIG. 1;

Figure 1:
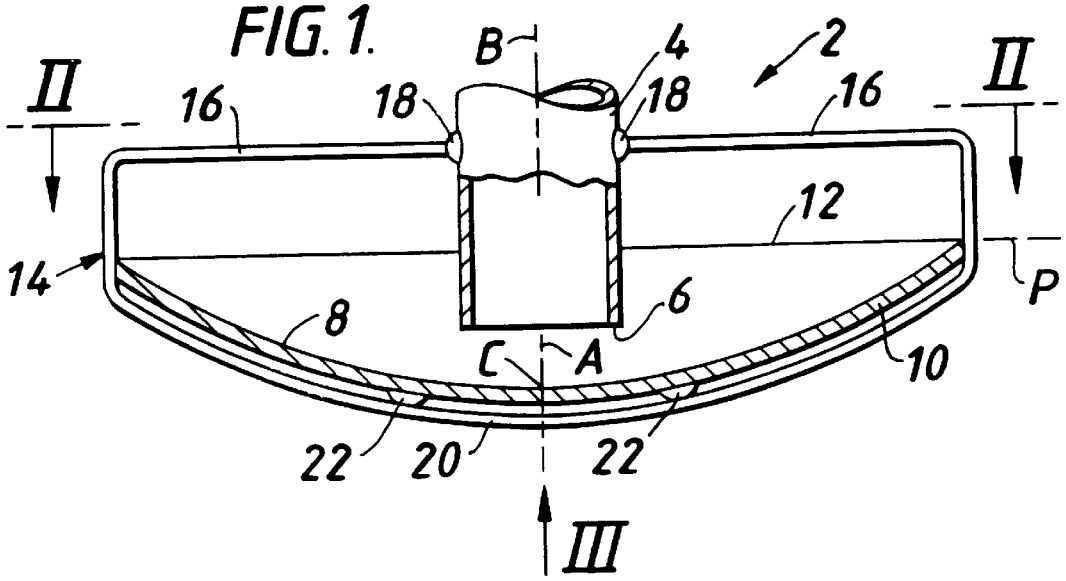
Figure 2:
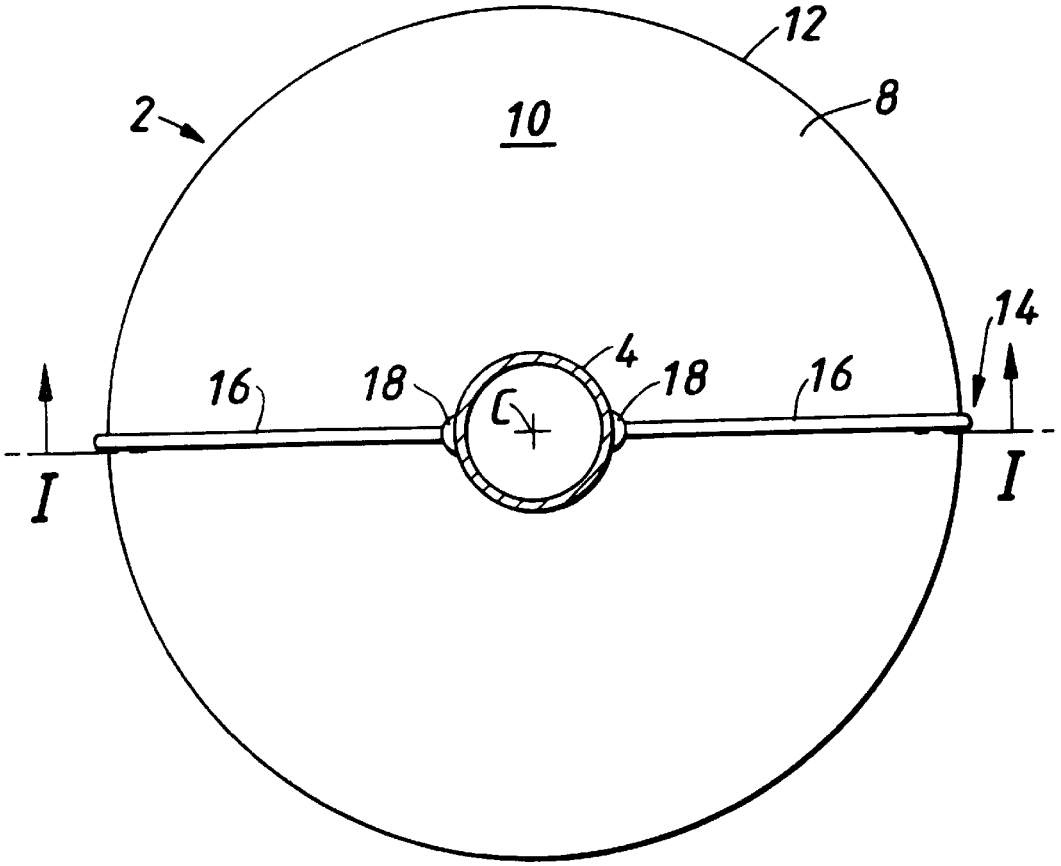
Figure 3:
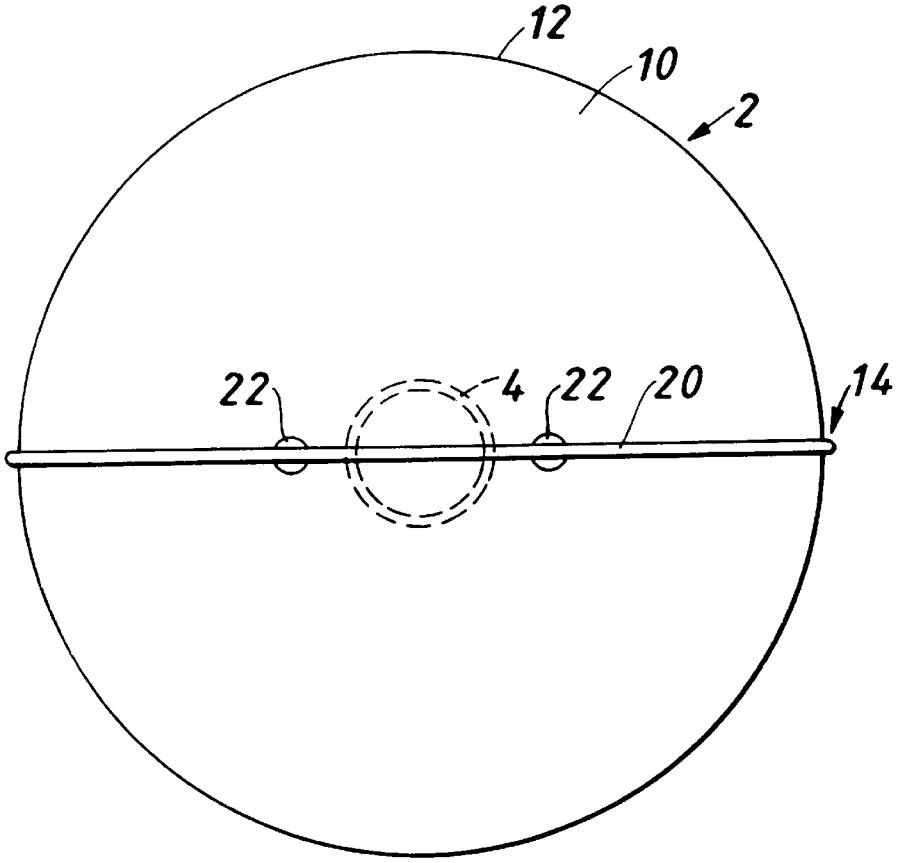
Figure 8:
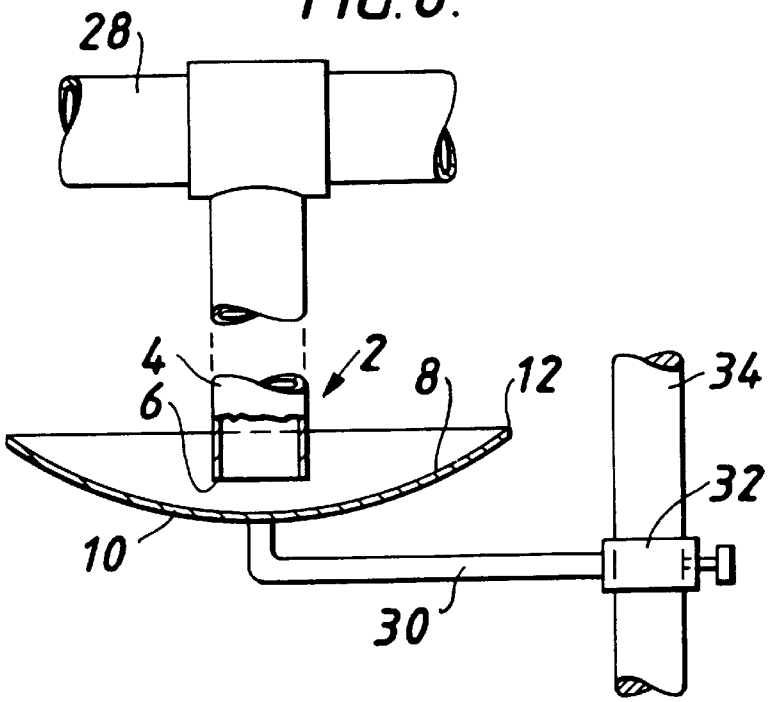
Figure 9:
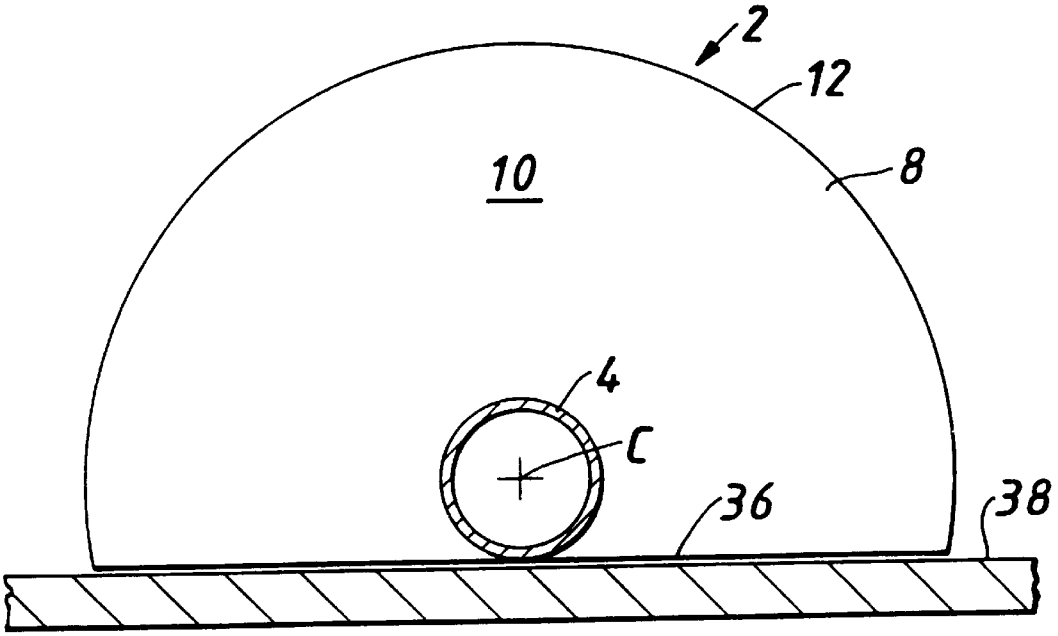
Figure 10:
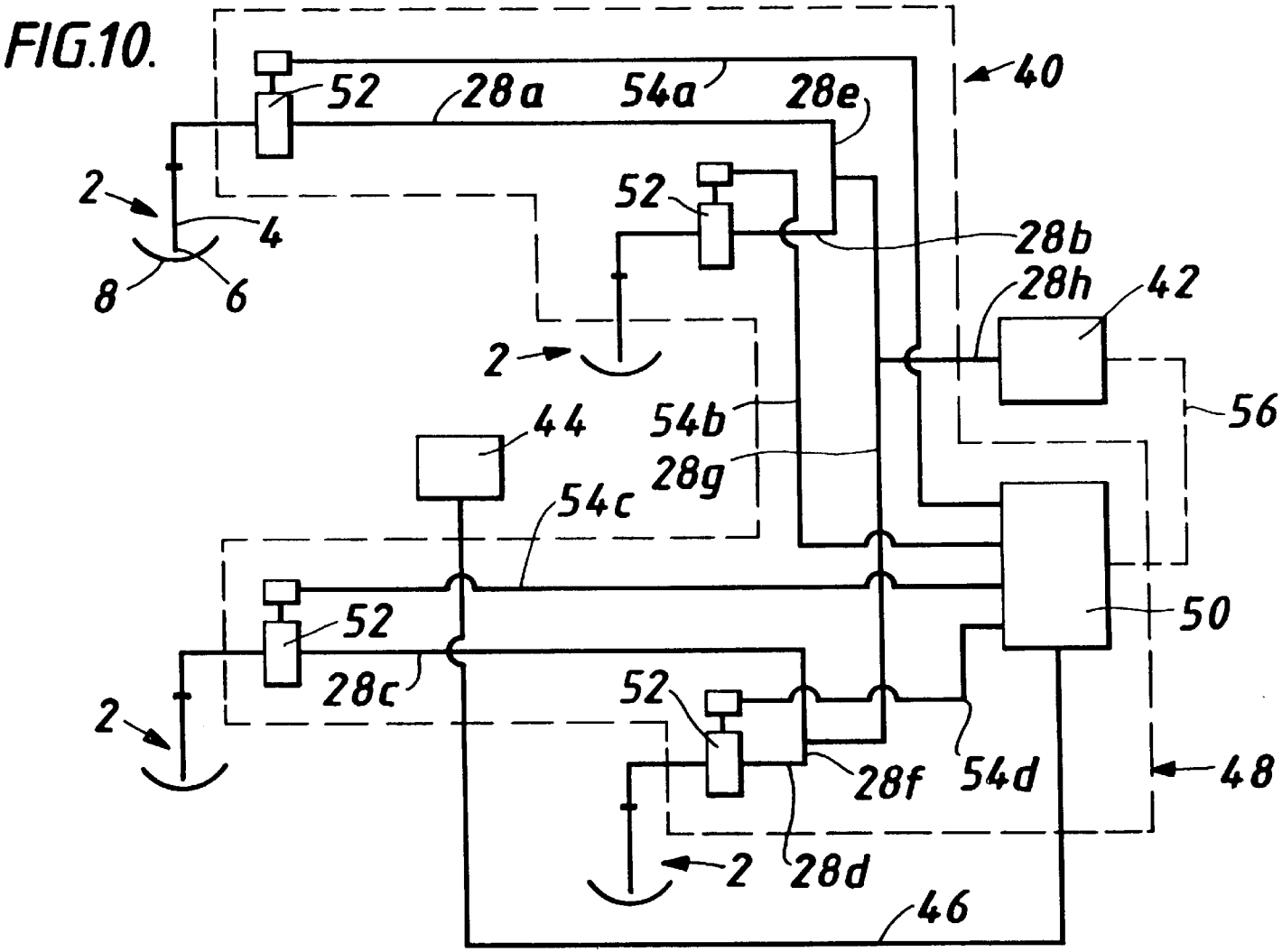

FIG. 8 in view, partly in section and similar to FIG. 1, of yet another embodiment of liquid delivery nozzle formed according to the invention, and wherein the dispersion plate is shown mounted on a support and the tube is shown connected to a supply of liquid;

FIG. 9 is a diagrammatic plan view, partly in section, of a further embodiment of a nozzle formed according to the invention mounted on a partition or wall, and FIG. 10 is a diagrammatic representation of an explosion suppression and/or fire extinguishing arragement including liquid delivery nozzles each as shown in FIGS. 1 to 3.

In the following description like reference numerals refer to like or comparable parts.

With reference to FIGS. 1 to 3, a liquid delivery nozzle 2 comprises a jet or substantially cylindrical tube 4 into which a liquid, for example water, under pressure is supplied at one end to emerge at an output end 6.

The output end 6 faces towards a concave side 8 of a dispersion plate 10 of curved, dish form and having a substantially circular periphery 12. The concave side 8 of the dispersion plate 10 may be substantially a surface of revolution about an axis A passing through centre C of the plate and being at substantially 90° to the side 8 at the point where the surface 8 and the axis A intersect at C. The plate 10 may be but is not necessarily, substantially a segment of a hollow sphere.

The concave side 8 is impervious, which means that the plate 10 has no holes or openings therethrough, and the concave side is a surface which is substantially smooth and continuous and thus has no grooves therein nor projections thereon.

The plate 10 is supported from the tube 4 by a support or strut 14 having co-linear radially extending arm portions 16 welded or otherwise secured at 18 to the tube and interconnected by a bowed, lower supporting section 20 welded or otherwise secured at 22 to the convex side of the plate.

The output end 6 of the tube 4 is directed towards the centre of the plate 10 such that the centre C of the plate lies substantially on axis B of the tube. The axes A and B may be co-linear, in which case the axes B is at substantially 90° to a plane P containing the periphery 12 and also at substantially 90° to the portion of the concave side 8 at or immediately adjacent to the centre C. The output end 6 has substantially the same shape as the lower end of a through tube which is a vertical right cylinder. The concave side 8 is spaced from the output end 6 which in a preferred version of the nozzle is at a position between the plane P of the periphery 12 and the concave side 8.

Figure 4:
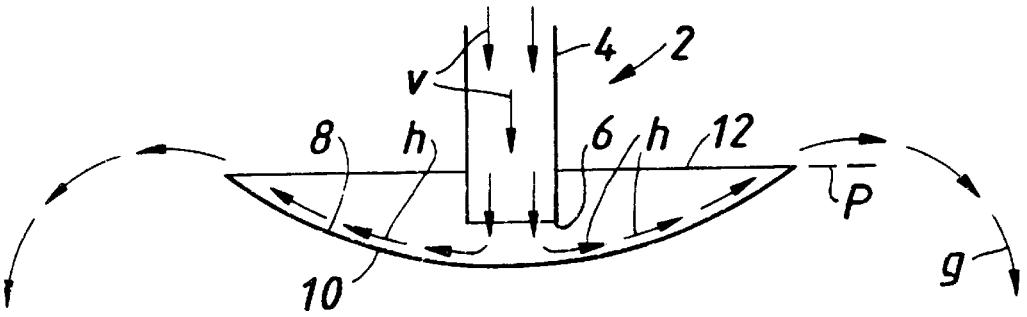
FIG. 4 is a representation of the delivery nozzle in FIG. 1 illustrating how liquid supplied to delivery nozzle is delivered therefrom.

In use the nozzle 2 is disposed as in FIG. 4 with the plate 10 substantially horizontal (i.e. the plane P in which the periphery 12 lies being substantially horizontal) and the concave side 8 facing upwards. Liquid is delivered downwards through the tube 4 in the direction of arrows v so that its velocity is wholly or mainly composed of a vertical component. On emerging from output end 6, the liquid impacts on the concave side 8, changes direction by approximately 90° and spreads radially outwards thereover as indicated by arrows h. As the liquid flows over the surface 8 towards the periphery 12 and at the periphery, the liquid velocity is mainly composed of an horizontal component so that at the instant when the liquid leaves the plate periphery 12 it has a velocity component which is wholly or mainly horizontal; thereafter the effect of gravity gives the liquid an increasing vertical component of velocity as suggested by arrow g.

The liquid can be water delivered down the tube 4 to emerge at a pressure of up to or about 5.0 barg at substantially the output end 6. Preferably the water pressure is in the range of substantially 0.3 barg to substantially 0.5 barg, and when the water is at such pressure about or substantially 98% by volume of the water, which has emerged from the output end 6, becomes converted into large drops flying beyond the plate periphery 12; such large drops may each have a diameter which is substantially 0.7 millimeters or greater. The water may be fresh water or sea water or water with additives.

Because the concave side 8 is impervious, smooth and continuous it does not cause fragmentation or dispersal into particles of a water film flowing over it. The combination of a relatively wide tube 4 and suitable water flow rate therethrough can give the water a relatively low vertical velocity which can create a thick film of water flowing over the concave side 8 and having substantially zero vertical velocity at the periphery 12, which again assists in minimising aerodynamic fragmentation or dispersal of the water.

Figure 5:
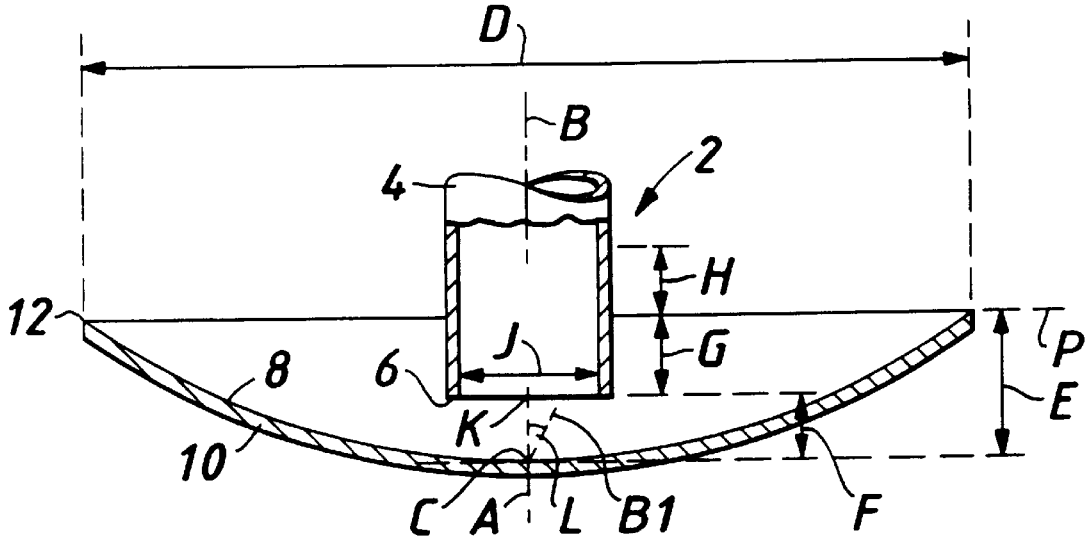
FIG. 5 is representation of the nozzle in FIG. 1 to illustrate ranges of dimensions which component parts or features of a delivery nozzle, formed according to the invention, may have.

Suitable dimensioning of the liquid delivery nozzle 2 is set out below with reference to FIG. 5. The dispersion plate 10 may have a diameter D in the range of substantially 60.0 m.m. (millimeters) to substantially 200.0 m.m., and preferably D is substantially 105.0 m.m. The dispersion plate 10 may have an internal depth E (that is the distance between the plane P in which the periphery 12 lies and the centre C on the concave side 8) in the range of substantially 2.0 m.m. to substantially 30.0 m.m., preferably E is substantially 10.0 m.m The output end or orifice 6 has a centre K which is distance F from the centre C of the concave side 8, where F may be in the range of substantially 1.0 m.m to 10.0 m.m., and preferably F is substantially 4.0 m.m. The output end 6 has an orifice or internal diameter J which may be in the range of substantially 3.0 m.m. to substantially 35.0 m.m., and preferably J is substantially 25.0 m.m. The centre C lies substantially on the axis B of the output end 6, but as indicated by broken line B1 the axis B may be at angle L to the axis A which angle L may be in the range of substantially 0° to substantially 10°, and preferably L is 0° (i.e. the axis B is at substantially 90° to the concave side 8 at or adjacent to the centre C). Output end 6 may be positioned at or to either side of the plane P so that the outlet end may be relative to the plane P at a distance H therefrom outside of the volume bounded by the concave side 8 where H may be the range of 0 to substantially 5.00 m.m. or the output end 6 may be, relative to the plane P, at a distance G therefrom within the volume bounded by the said concave side where G may be in range of 0 to substantially 20.0 m.m.; preferably the output end 6 is within said volume and the distance G is substantially 6.0 m.m..

When the internal diameter of the output end 6 is substantially 25 m.m. and the water pressure is preferably in the range of about 0.3 to about 0.5 barg, the flow rate of the water can be about 150 liters per minute from the output end.

Figure 6:
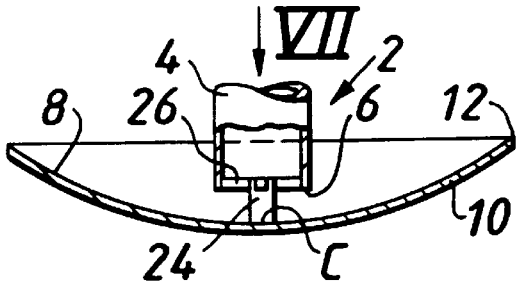
FIG. 6 is a fragmentary view, partly in section on line VI—VI in FIG. 7, of another embodiment of delivery nozzle formed according to the invention.
Figure 7:
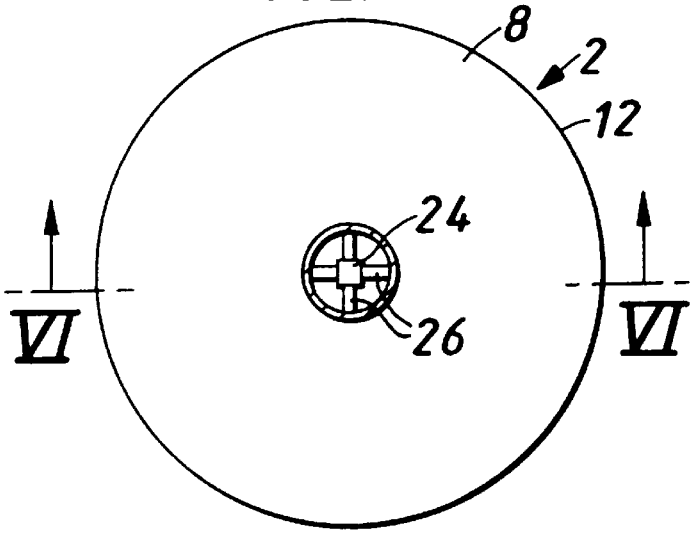
FIG. 7 is a view of the delivery nozzle in FIG. 6, in the direction of arrow VII.

In FIGS. 6 and 7, the liquid delivery nozzle 2 has its plate 10 mounted at its centre C on an ascending leg 24 substantially normal to the concave surface 8 and secured to the intersection point of radial struts 26 mounted on and within the output end 6.

Liquid delivery nozzle 2 in FIG. 8 has its tube 4 depending from a pipe 28 carrying the supply of liquid, for example water, to the tube. The dispersion plate 10 is mounted on one end of a carrier arm 30 having at its other end a releasable locking device 32 which may be moved up and down a substantially vertical support 34 to bring the plate 10 to desired position relative to the output end 6 at which point the locking device is locked to hold the plate 10 in said desired position.

The dispersion plate 10, with the concave side 8, of the nozzle 2 in FIG. 9 has a periphery 12 which is substantially a segment of a circle, of which circle edge 36 of the plate is a chord. The circle is again centred at C which can be regarded as the centre of the dispersion plate 10 or of the concave side 8, since the concave side of the dispersion plate may be a surface of revolution about an axis passing through point C. The nozzle 2 can be mounted with the chord or edge 36 adjacent to a substantially vertical partition or wall 38.

In FIG. 9 the plate 10 and tube 4 may be connected together as in FIGS. 1 to 3 or in FIGS. 6 and 7, or may be mounted in place separately from each other.

To provide an explosion suppression and/or fire extinguishing arrangement a plurality of aforesaid nozzles 2 are provided. Each nozzle 2 is mounted at a desired height with its plate 10 (or more particularly with the plane P containing the plate periphery 12) substantially horizontal and with the curved side 8 facing upwards. The nozzles 2 are spaced apart and disposed in and/or around an area where combustible or explosive material for example combustible gases or liquids, is being handled or stored for water to be delivered to the nozzles in the event of a potentially explosive condition being detected. The water may issue from the output ends 6 at a pressure of up to substantially 5.0 barg, and preferably at about substantially 0.3 barg to substantially 0.5 barg. When the apparatus is to be used to prevent, suppress or impede the occurrence, development, progress and effect of an explosion of explosive gas or vapour, for example natural gas, gas or vapour detection means is provided to observe a leak of the gas or vapour or an increase in concentration of the gas or vapour to a predetermined amount and then cause control means to cause automatic supply of water to the nozzles in anticipation that an explosion may be about to occur. Such a system can be provided on an off-shore natural gas or oil drilling or production platform. The system may also be used as a fire extinguishing system in which fire detection means is provided to observe an outbreak of fire and cause the control means to cause automatic supply of water to the nozzles.

Such an explosion suppression and/or fire extigguishing arragement is shown at 40 in FIG. 10 in which a plurality of nozzles 2 are connected by pipes 28*a,* 28*b,* 28*c,* 28*d,* 28*e,* 28*f,* 28*g,* and 28*h* to a supply of water 42, for example a water tower or header tank, or water pump means. Detection means is shown at 44. The dertection means 44 is arranged for observing the occurrence of one or more characteristics symptomatic or indicative of an explosion or a potentially explosive condition and/or symptomatic or indicative of a fire, and when such a characteristic is observed the detection means sends a warning signal on line 46 to control means 48 comprising a control 50 and normally closed valves 52. In response to the warning signal the control 50 causes signals to be sent on lines 54*a,* 54*b,* 54*c,* and 54*d* to cause the automatic opening of the valves 52. When the valves 52 open water can be supplied to the nozzles 2 from the supply means 42. Either the supply means can be a water tower or tank from which the watr discharges under gravity, or it may be a water pump operated operated to pump water towards the nozzles in response to a signal on line 56 from the control 54 in response to occurence of a said warning signal.

In an alternative disposition to that shown in FIGS. 1 to 9 one or more of said nozzles 2 may be mounted so that the concave side 8 faces downwards and water emerges upwardly from the tube 4 to hit the concave side.

What is claimed is:

1. A liquid delivery nozzle for delivering liquid in the form of a stream of drops of which the majority are large drops, the liquid delivery nozzle comprising a tube for liquid to be introduced into one end of said tube and emerge from another or output end of said tube, and a dispersion plate of dish-form being concave on one side of said plate, said output end facing towards said concave side of the plate for liquid emerging from the output end to be directed against the concave side, said dispersion plate being impervious, and said concave side being substantially smooth and continuous, and wherein said dispersion plate is configured to discharge drops of the liquid, a majority of which have a diameter of at least substantially 0.7 millimeters.

2. A liquid delivery nozzle as claimed in claim 1, in which the dispersion plate has a periphery of which at least part of said periphery in a portion of a figure which is substantially circular.

3. A liquid delivery nozzle as claimed in claim 2, in which the periphery of of the dispersion plate is substantially circular or is substantially a segment of a circle.

4. A liquid delivery nozzle as claimed in claim 1, in which said concave side is substantially a surface of revolution about an axis on which lies a centre of said concave side.

5. A liquid delivery nozzle as claimed in claim 1, in which said outlet end has an axis on which substantially lie a centre of the output end and a/the centre of said concave side.

6. A liquid delivery nozzle as claimed in claim 4, in which the axis of the output end is at an angle to the axis of the concave side, and said angle is in the range of 0° to substantially 10°.

7. A liquid delivery nozzle as claimed in claim 4, which the axis of the output end is substantially co-linear with the axis of the concave side.

8. A liquid delivery nozzle as claimed in claim 2 in which said circular periphery or circular portion of said periphery has a diameter lying in the range of substantially 60.0 millimeters to substantially 200.0 millimeters.

9. A liquid delivery nozzle as claimed in claim 8, in which said diameter is substantially 105.0 millimeters.

10. A liquid delivery nozzle as claimed claim 1, in which said output end has a substantially circular internal cross-section, and said output end has an internal diameter lying in the range of substantially 3.0 millimeters to substantially 35.0 millimeters.

11. A liquid delivery nozzle as claimed in claim 10, in which said internal diameter is substantially 25.0 millimeters.

12. A liquid delivery nozzle as claimed in claim 2 in which said periphery or circular portion of said periphery lies in a plane and said plane is spaced from a/the centre of said concave side by a minimum distance lying in the range of substantially 2.0 millimeters to substantially 30.0 millimeters.

13. A liquid delivery nozzle as claimed in claim 12, in which said minimum distance is substantially 10.0 millimeters.

14. A liquid delivery nozzle as claimed in claim 1, in which a/the centre of said output end is spaced from a/the centre of said concave side by a distance lying in the range of substantially 1.0 millimeters to 10.0 millimeters.

15. A liquid delivery nozzle as claimed in claim 14, in which the distance between said centre of the output end and said centre of the concave side is substantially 4.0 millimeters.

16. A liquid delivery nozzle as claimed in claim 1, in which said concave side has periphery lying in a/the plane and the output end is disposed at said plane or outside the volume bounded by said concave side and is spaced from said plane by distance lying in the range of 0 to substantially 5.0 millimeters.

17. A liquid delivery nozzle as claimed in claim 1, in which a/the periphery of said concave side lies in a/the plane or a circular portion of said periphery lies in said plane, and the output end is disposed at said plane or within the volume bounded by said concave side and spaced from said plane by a distance lying in the range of 0 to substantially 20.0 millimeters.

18. A liquid delivery nozzle as claimed in claim 17, in which the output end is spaced from said plane by substantially 6.0 millimeters.

19. A liquid delivery nozzle as claimed in claim 1 in which the dispersion plate is mounted on the tube.

20. A liquid delivery nozzle as claimed in claim 19, in which the dispersion plate is mounted on arm means mounted on the tube and extending over said concave side.

21. A liquid delivery nozzle as claimed in claim 19, in which the dispersion plate is mounted on leg means mounted on said tube and extending from said output end.

22. A liquid delivery nozzle as claimed in claim 1, in which at least one of said output end and said concave side is movable one relative to the other whereby a distance between the output end and the concave side can be varied.

23. A liquid delivery nozzle as claimed in claim 1 mounted with the concave side facing upwards.

24. A liquid delivery nozzle as claimed in claim 1 connected to a supply of water arranged for supplying water through the tube to said output end at a pressure of up to substantially 5.0 barg.

25. A liquid delivery nozzle as claimed in claim 24 in which the water pressure is in the range of substantially 0.3 barg to substantially 0.5 barg.

26. An installation to prevent, suppress or impede the occurrence, development, progress effect of an explosion of explosive gas or vapour, comprising one or more liquid delivery nozzles as claimed in claim 1, the/or each nozzle being mounted with its concave side facing upwards and with said tube connected to a supply of water for delivery to the output end of the tube, detector means to detect a phenomenon indicative of the possibility of occurrence of an explosion, and control means responsive to said detector means to cause said supply to deliver water to the/or each output end upon said phenomenon being detected.

27. An installation to extinguish or control spread of a fire comprising one or more liquid delivery nozzles as claimed in claim 1, the/or each nozzle being mounted with its concave side facing upwards and with the said tube connected to a supply of water for delivery to the output end of the tube, fire detector means, and control means responsive to said fire detector means to cause said supply to deliver water to the/or each output end upon a fire being detected.

28. An installation as claimed in claim 26 provided on a gas or oil drilling or production platform.

29. A liquid delivery system comprising:

a liquid source configured to output a liquid at a pressure; and a nozzle connected to said liquid source, wherein said nozzle comprises a discharge tube fluidically connected to said liquid source and a dispersion plate having a concave side facing an output end of said discharge tube;

wherein at least one of said pressure, a diameter of said dispersion plate, a depth of said concave side of said dispersion plate, a distance between the output end of said discharge tube and a center of said concave side are configured such that a majority of drops discharged from said dispersion plate when the liquid flows through the output end of the discharge tube have a diameter of at least substantially 0.7 millimeters.

30. The liquid delivery system according to claim 29, wherein said pressure is no greater than substantially 5.0 barg.

31. The liquid delivery system according to claim 30, wherein said pressure is from substantially 0.3 barg to substantially 0.5 barg at said output end of said discharge tube.

32. The liquid delivery system of claim 29, wherein said diameter of said dispersion plate is from substantially 60 millimeters to substantially 200 millimeters.

33. The liquid delivery system according to claim 32, wherein said diameter is substantially 105 millimeters.

34. The liquid delivery system according to claim 29, wherein said internal depth is from substantially 2 millimeters to substantially 30 millimeters.

35. The liquid delivery system according to claim 34, wherein said internal depth is substantially 10 millimeters.

36. The liquid delivery system according to claim 29, wherein said distance between the output end and said concave side is from substantially 1 millimeter to substantially 10 millimeters.

37. The liquid delivery system according to claim 36, wherein said distance is substantially 4 millimeters.

38. The liquid delivery system according to claim 29, wherein said internal diameter of said output end of said tube is from substantially 3 millimeters to substantially 35 millimeters.

39. The liquid delivery system according to claim 38, wherein said internal diameter is substantially 25 millimeters.

40. The liquid delivery system according to claim 29, wherein an angle between an axis of said output end and said center of said concave side of said dispersion plate is from substantially 0° to substantially 10°.

41. The liquid delivery system according to claim 29, wherein said dispersion plate is mounted to said discharge tube.

42. A liquid delivery system comprising:

a liquid source configured to output a liquid at a pressure of up to substantially 5.0 barg;

a nozzle connected to said liquid source, wherein said nozzle comprises a discharge tube fluidically connected to said liquid source and having an output end with an internal diameter from substantially 3 millimeters to substantially 35 millimeters; and a dispersion plate having a concave side directed to said output end of said discharge tube, said dispersion plate having a diameter of from substantially 60 millimeters to substantially 200 millimeters, said concave side having an internal depth of from substantially 2 millimeters to 30 millimeters;

wherein a distance between said output end of said discharge tube and a center of said concave side is from substantially 1 millimeter to 10 millimeters;

wherein at least one of said pressure, said diameter of said dispersion plate, said internal depth, said distance between said output end and said center of said concave side, and said internal diameter of said output end are configured such that a majority of drops discharged from said dispersion plate have a diameter of at least substantially 0.7 millimeters.

43. A liquid delivery system comprising:

a liquid source; and dispersion means fluidically connected to said liquid source, for dispersing liquid from said liquid source such that a majority of drops of the liquid discharged from said dispersion means have a diameter of at least substantially 0.7 millimeters.

* * * * *